United States Patent [19]

Kudo et al.

[11] 4,400,211

[45] Aug. 23, 1983

[54] ALLOY FOR MAKING HIGH STRENGTH DEEP WELL CASING AND TUBING HAVING IMPROVED RESISTANCE TO STRESS-CORROSION CRACKING

[75] Inventors: Takeo Kudo, Suita; Yasutaka Okada, Nishinomiya; Taishi Moroishi, Kobe; Akio Ikeda, Hyogo; Hiroo Ohtani, Kobe; Kunihiko Yoshikawa, Suita, all of Japan

[73] Assignee: Sumitomo Metal Industries, Ltd., Osaka, Japan

[21] Appl. No.: 383,630

[22] Filed: Jun. 1, 1982

[30] Foreign Application Priority Data

| | | | |
|---|---|---|---|
| Jun. 10, 1981 | [JP] | Japan | 56-89106 |
| Jun. 11, 1981 | [JP] | Japan | 56-89961 |
| Jun. 12, 1981 | [JP] | Japan | 56-90605 |
| Jun. 15, 1981 | [JP] | Japan | 56-92028 |
| Jun. 17, 1981 | [JP] | Japan | 56-93174 |

[51] Int. Cl.[3] ..... C22C 19/05; C22C 38/18

[52] U.S. Cl. ..... 420/443; 420/451; 420/452; 420/453; 420/454; 420/585

[58] Field of Search ..... 420/443, 451, 452, 453, 420/454, 585; 75/134 C, 134 F, 171

[56] References Cited

U.S. PATENT DOCUMENTS

| | | | |
|---|---|---|---|
| 2,955,934 | 10/1960 | Emery | 420/585 |
| 3,876,423 | 4/1975 | Firnhaber | 420/585 |
| 4,095,976 | 6/1978 | Herchenroeder | 420/585 |
| 4,119,456 | 10/1978 | Roach et al. | 420/452 |
| 4,168,188 | 9/1979 | Asphahani | 148/427 |
| 4,171,217 | 10/1979 | Asphahani et al. | 420/585 |
| 4,174,213 | 11/1979 | Fukui et al | 420/451 |
| 4,245,698 | 1/1981 | Berkowitz et al. | 148/11.5 N |

*Primary Examiner*—Veronica O'Keefe

*Attorney, Agent, or Firm*—Burns, Doane, Swecker and Mathis

[57] ABSTRACT

An alloy useful for manufacturing high strength deep well casing, tubing and drill pipes for use in oil-well operations is disclosed. The alloy exhibits improved resistance to stress corrosion cracking in the $H_2S-CO_2-Cl^-$ environment, which comprises the following alloy composition:

| | |
|---|---|
| C: ≦0.1% | Si: ≦1.0% |
| Mn: ≦2.0% | P: ≦0.030% |
| S: ≦0.005% | N: 0–0.30% |
| Ni: 30–60% | Cr: 15–35% |
| Mo: 0–12% | W: 0–24% |
| Cr(%) + 10Mo(%) + 5W(%) ≧ 110% | |
| 7.5% ≦ Mo(%) + ½W(%) ≦ 12% | |
| Cu: 0–2.0% | Co: 0–2.0% |
| rare earths: 0–0.10% | Y: 0–0.20% |
| Mg: 0–0.10% | Ca: 0–0.10% |
| one or more of Nb, Ti, Ta, Zr and V in the total amount of 0.5–4.0%, if necessary | |
| Fe and incidental impurities: balance. | |

22 Claims, 8 Drawing Figures

BASIC COMPOSITION:

| C | Si | Mn | S | P | N | Nb | V |
|---|---|---|---|---|---|---|---|
| 0.005 | 0.1 | 0.6 | 0.001 | 0.008 | 0.15 | 0.5 | 0.5 |

ALLOY FOR MAKING HIGH STRENGTH DEEP WELL CASING AND TUBING HAVING IMPROVED RESISTANCE TO STRESS-CORROSION CRACKING

This invention relates to an alloy composition which has high strength as well as improved resistance to stress corrosion cracking and which is especially useful for manufacturing casing, tubing and drill pipes for use in deep wells for producing oil, natural gas, or geothermal water (hereunder referred to as "deep well" collectively).

Recently, in exploring for and reaching new sources of oil and natural gas, wells are being drilled deeper and deeper. Oil-wells 6000 meters or more are no longer unusual, and oil-wells 10,000 meters or more deep have been reported.

A deep well, therefore, is inevitably exposed to a severe environment. In addition to the high pressure, the environment of a deep well contains corrosive materials such as carbon dioxide and chlorine ions as well as wet hydrogen sulfide under high pressure.

Thus, casing, tubing and drill pipes (hereunder referred to as "casing and tubing", which mean, in general, oil country tubular goods) for use in oil-wells under such severe conditions must have high strength and improved resistance to stress corrosion cracking. In a general aspect, as one of the known measures used to prevent oil-well casing and/or tubing from stress corrosion cracking, it has been known in the art that a corrosion-suppressing agent called "inhibitor" is injected into the well. However, this measure to prevent corrosion cannot be used in all cases; for example, it is not applicable to offshore oil-wells.

Therefore, recently the use of a high-grade corrosion-resistant, high-alloy steel such as stainless steels, Incoloy (tradename) and Hastelloy (tradename) has been tried. However, the behavior of such materials under a corrosive environment including $H_2S$-$CO_2$-$Cl^-$ system like that found in deep oil-wells has not been studied thoroughly up to now.

U.S. Pat. No. 4,168,188 to Asphahani discloses a nickel base alloy containing 12–18% of molybdenum, 10–20% of chromium and 10–20% of iron for use in manufacturing well pipes and tubing. U.S. Pat. No. 4,171,217 to Asphahani et al also discloses a similar alloy composition in which this time the carbon content is limited to 0.030% maximum. U.S. Pat. No. 4,245,698 to Berkowitz et al discloses a nickel base superalloy containing 10–20% of molybdenum for use in sour gas or oil wells.

The object of this invention is to provide an alloy for use in manufacturing deep well casing and tubing which will have sufficient strength and high enough resistance to stress corrosion cracking to endure deep well drilling as well as a severely corrosive environment, especially that including $H_2S$-$CO_2$-$Cl^-$ system (hereunder referred to as "$H_2S$-$CO_2$-$Cl^-$-containing environment", or merely as "$H_2S$-$CO_2$-$Cl^-$-environment").

Figure 1:
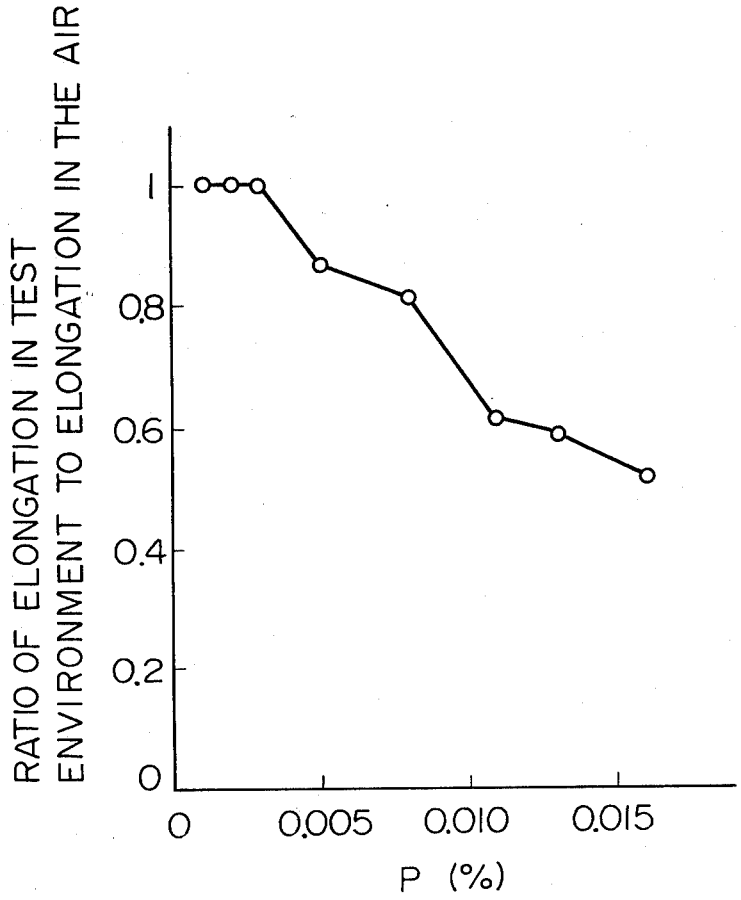
FIG. 1 shows the relationship between the ratio of an elongation in test environment to that in the air and the P content.

In the course of our research we found the following:

(a) Under corrosive environments containing $H_2S$, $CO_2$ and chloride ions ($Cl^-$), corrosion proceeds mainly by way of stress corrosion cracking. The mechanism of stress corrosion cracking in those cases, however, is quite different from that generally found in austenitic stainless steels. That is, the primary cause of the stress corrosion cracking in the case of austenitic stainless steel is the presence of chloride ions ($Cl^-$). In contrast, the primary cause of such stress corrosion cracking as found in casing and/or tubing in deep oil-wells, is the presence of $H_2S$, although the presence of $Cl^-$ ions is also a factor.

(b) Alloy casing and tubing to be used in deep oil-wells are usually subjected to cold working in order to improve strength. However, cold working seriously decreases the resistance to stress corrosion cracking.

(c) The corrosion rate of an alloy in a corrosive $H_2S$-$CO_2$-$Cl^-$-environment depends on the Cr, Ni, Mo and W content of the alloy. If the casing or tubing has a surface layer comprised of these elements, the alloy not only has better resistance to corrosion in general, but also it has improved resistance to stress corrosion cracking even under the corrosive environment found in deep oil wells. Specifically, we found that molybdenum is 10 times as effective as chromium, and molybdenum is twice as effective as tungsten to improve the resistance to stress corrosion cracking. Thus, we found chromium (%), tungsten (%) and molybdenum (%) are satisfied by the equation:

$$Cr(\%)+10Mo(\%)+5W(\%) \geqq 110\%$$

$$7.5\% \leqq Mo(\%)+\tfrac{1}{2}W(\%) \leqq 12(\%)$$

In addition, the Ni content is 30–60% and the chromium content is 15–35%. Then even after having been subjected to cold working, the resulting alloy surface layer retains markedly improved resistance to corrosion in a $H_2S$-$CO_2$-$Cl^-$-enviroment, particularly one containing concentrated $H_2S$ at a temperature of 200° C. or higher.

(d) The addition of nickel is effective not only to improve the resistance of the surface layer to stress corrosion cracking, but also to improve the metallurgical structure itself of the alloy. Thus, the addition of nickel results in markedly improved resistance to stress corrosion cracking.

(e) Sulfur is an incidental impurity, and when the S content is not more than 0.0007%, hot workability of the resulting alloy is markedly improved.

(f) Phosphorous, too, is an incidental impurity, and when the P content is not more than 0.003%, the susceptibility to hydrogen embrittlement is markedly reduced.

(g) When Cu in an amount of not more than 2.0% and/or Co in an amount of not more than 2.0% is added to the alloy as additional alloying elements, the resistance to corrosion is further improved.

(h) When one or more of the following alloying elements is added to the alloy in the proportion indicated, the hot workability is further improved: rare earths, not more than 0.10%; Y, not more than 0.2%; Mg, not more than 0.10%; and Ca, not more than 0.10%.

(i) When one or more of the following alloying elements is added to the alloy, the total amount being within the range of 0.5–4.0%, the strength of the alloy is further improved due to precipitation hardening effect caused by these additives: Nb, Ti, Ta, Zr and V.

(j) When nitrogen in an amount within the range of 0.05–0.30% is intentionally added to the alloy as an alloying element, the strength of the resulting alloy is further improved without any reduction in corrosion resistance.

(k) A preferred nitrogen content is from 0.05–0.25%, when at least one of Nb and V in the total amount of 0.5–4.0% is added to the alloy. In this case the strength of the resulting alloy is further improved due to precipitation hardening of these additives without any reduction in corrosion resistance.

This invention has been completed on the basis of the discoveries mentioned above, and resides in an alloy composition for use in manufacturing high strength deep well casing and tubing having improved resistance to stress corrosion cracking, which comprises:

C: not more than 0.10%, preferably not more than 0.05%

Si: not more than 1.0%,

Mn: not more than 2.0%,

P: not more than 0.030%, preferably not more than 0.003%,

S: not more than 0.005%, preferably not more than 0.0007%,

Ni: 30–60%, preferably 40–60%,

Cr: 15–35%, at least one of Mo: not more than 12%, and

W: not more than 24%, with the following equations being satisfied:

$$Cr(\%)+10Mo(\%)+5W(\%)\geqq 110\%, \text{ and}$$

$$7.5\%\leqq Mo(\%)+\tfrac{1}{2}W(\%)\leqq 12\%$$

and the balance iron with incidental impurities.

The alloy of this invention may further comprise any combination of the following:

(i) One of Cu, not more than 2.0%, and/or Co, not more than 2.0%.

(ii) One or more of rare earths, not more than 0.10%; Y, not more than 0.20%; Mg, not more than 0.10%; and Ca, not more than 0.10%.

(iii) One or more of Nb, Ti, Ta, Zr and V in the total amount of from 0.5–4.0%.

(iv) Nitrogen in an amount of 0.05–0.30%, preferably 0.10–0.25% may be intentionally added to the alloy.

In another embodiment, nitrogen may be added in an amount of 0.05–0.25% in combination with Nb and/or V added in the total amount of 0.5–4.0%.

Therefore, in a broad aspect, this invention resides in an alloy for manufacturing high strength deep well casing and tubing having improved resistance to stress corrosion cracking, the alloy composition of which is:

| | |
|---|---|
| C: ≦0.1% | Si: ≦1.0% |
| Mn: ≦2.0% | P: ≦0.030% |
| S: ≦0.005% | N: 0–0.30% |
| Ni: 30–60% | Cr: 15–35% |
| Mo: 0–12% | W: 0–24% |
| Cr(%) + 10Mo(%) + 5W(%) ≧ 110% | |

-continued

| | |
|---|---|
| 7.5% ≦ Mo(%) + ½W(%) ≦ 12% | |
| Cu: 0–2.0% | Co: 0–2.0% |
| rare earths: 0–0.10% | Y: 0–0.20% |
| Mg: 0–0.10% | Ca: 0–0.10% |
| Fe and incidental impurities: balance. | |

When the nitrogen is intentionally added, the lower limit is 0.05%. The alloy of this invention may further comprises at least one of Nb, Ti, Ta, Zr and V in the total amount of 0.5–4.0%.

Now, the reasons for defining the alloy composition of this invention as in the above will be described:

Carbon (C):

When the carbon content is over 0.10%, the alloy is rather susceptible to stress corrosion cracking. The upper limit thereof is 0.1% and preferably the carbon content is not more than 0.05%.

Silicon (Si):

Si is a necessary element as a deoxidizing agent. However, when it is more than 1.0%, hot workability of the resulting alloy deteriorates. The upper limit thereof is defined as 1.0%.

Manganese (Mn):

Mn is also a deoxidizing agent like Si. It is to be noted that the addition of Mn has substantially no effect on the resistance to stress corrosion cracking. Thus, the upper limit thereof has been restricted to 2.0%.

Phosphorous (P):

P is present in the alloy as an impurity. The presence of P in an amount of more than 0.030% causes the resulting alloy to be susceptible to hydrogen embrittlement. Therefore, the upper limit of P is defined as 0.030%, so that susceptibility to hydrogen embrittlement may be kept at a lower level. It is to be noted that when the P content is reduced beyond the point of 0.003%, the susceptibility to hydrogen embrittlement is drastically improved. Therefore, it is highly desirable to reduce the P content to 0.003% or less when it is desired to obtain an alloy with remarkably improved resistance to hydrogen embrittlement.

FIG. 1 shows how a reduction in P content serves to improve the resistance to hydrogen embrittlement. A series of 25%Cr-50%Ni-10%Mo alloys in which the amount of P was varied were cast, forged and hot rolled to provide alloy plates 7 mm thick. The resulting plates were then subjected to solid solution treatment in which the plates were kept at 1050° C. for 30 minutes and water-cooled. After finishing the solid solution treatment cold working was applied with reduction in area of 30% in order to improve its strength. Specimens (1.5 mm thick × 4 mm wide × 20 mm long) were cut from the cold rolled sheet in a direction perpendicular to the rolling direction.

The specimens were subjected to a tensile test in which the specimens were soaked in a 5% NaCl solution (temperature 25° C.) saturated by $H_2S$ at a pressure of 10 atms and an electrical current of 5 mA/cm$^2$ was supplied using the specimen as a cathode. Tensile stress was then applied to the specimens at a constant strain rate of $8.3\times10^{-7}$/sec until the specimen broke. A tensile test was also carried out in the air to determine the elongation in the air. The ratio of the elongation in said $H_2S$-containing NaCl solution to that in the air was calculated. If hydrogen embrittlement occurs, the elongation would be decreased. Therefore, a ratio of 1 means that there was substantially no hydrogen embrittlement. The results are summarized in FIG. 1. As is apparent from the data shown in FIG. 1, when the P content is reduced to 0.003% or less, the resulting alloy shows remarkable resistance to hydrogen embrittlement.

Sulfur (S):

When the amount of S, which is present in alloy as an incidental impurity, is over 0.005%, the hot workability deteriorates. So, the amount of S in alloy is restricted to not more than 0.005% in order to prevent deterioration in hot workability. When the amount of S is reduced to 0.0007% or less, the hot workability is dramatically improved. Therefore, where hot working under severe conditions is required, it is desirable to reduce the S content to 0.0007% or less.

Figure 2:
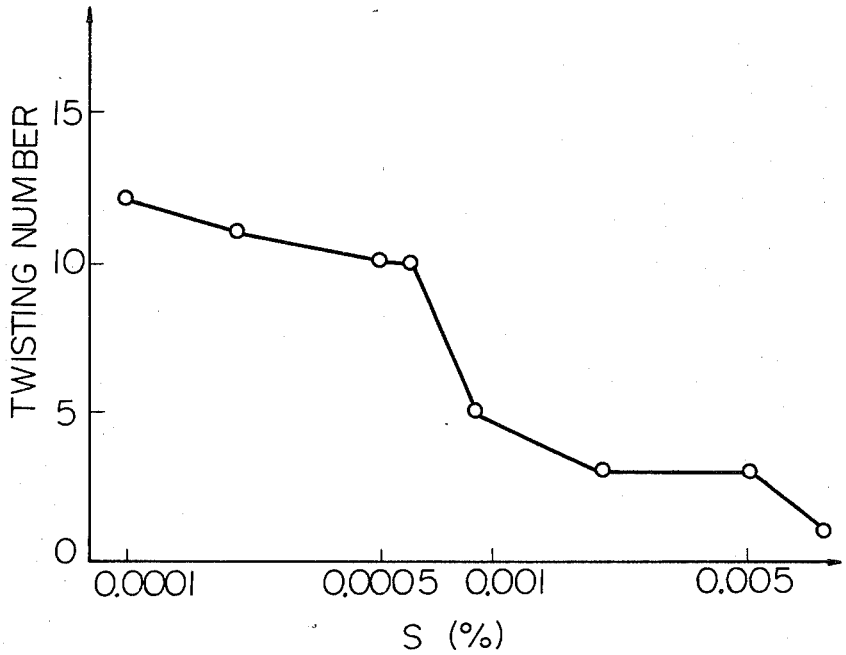
FIG. 2 shows the relationship between the twisting number and the S content.

FIG. 2 shows the results of a torsion test at the temperature of 1200° C. on a series of specimens of 25%Cr-50%Ni-10%Mo alloy in which the amount of S was varied. The specimens the dimension of the parallel portion of which is 8 mm diameter × 30 mm length were cut from alloy ingots of said alloys (weight 150 Kg). The torsion test is usually employed for the purpose of evaluating hot workability of metal materials. The data shown in FIG. 2 indicates that the number of torsion cycles, i.e. the torsion cycles applied until the breaking of the material occurs, increases markedly when the S content is reduced to 0.0007% or less, showing that hot workability has markedly been improved.

Nickel (Ni):

Ni is effective to improve the resistance to stress corrosion cracking. When nickel is added in an amount of less than 30%, however, it is impossible to impart a sufficient degree of resistance to stress corrosion cracking. On the other hand, when it is added in an amount of more than 60%, the resistance to stress corrosion cracking cannot be further improved. Thus, in view of economy of material the nickel content is restricted to 30–60%. The nickel content is preferably 40–60% in order to improve toughness.

Aluminum (Al):

Al, like Si and Mn, is effective as a deoxidizing agent. In addition, since Al does not have any adverse effect on properties of the alloy, the presence of Al in an amount of up to 0.5% as sol. Al may be allowed.

Chromium (Cr):

Cr is effective to improve the resistance to stress corrosion in the presence of Ni, Mo and W. However, less than 15% of Cr does not contribute to improvement in hot workability, and it is necessary to add such other elements as Mo and W in order to keep a desired level of resistance to stress corrosion cracking. From an economical viewpoint, therefore, it is not desirable to reduce the amount of Cr so much. The lower limit of the Cr content is defined as 15%. On the other hand, when Cr is added in an amount of more than 35%, hot workability deteriorates, even when the amount of S is reduced to less than 0.0007%.

Molybdenum (Mo) and Tungsten (W):

As already mentioned, both elements are effective to improve the resistance to stress corrosion cracking in the presence of Ni and Cr. However, when Mo and W are respectively added in amounts of more than 12% and more than 24%, the corrosion resistance properties cannot be improved any more under the $H_2S$-$CO_2$-$Cl^-$ environment at a temperature of 200° C. or higher. Therefore, by considering the economy of material, Mo is added in an amount of not more than 12% and/or W is added in an amount of not more than 24%. Regarding the Mo and W content, we have introduced the equation: $Mo(\%)+\frac{1}{2}W(\%)$. This is because, since the atomic weight of W is twice the atomic weight of Mo, Mo is as effective as $\frac{1}{2}W$ with respect to improvement in the resistance to stress corrosion cracking. When the value of this equation is less than 7.5%, it is impossible to obtain the desired level of resistance to stress corrosion cracking, particularly at a temperature of 200° C. or higher under the severe environment. On the other hand, a value of larger than 12% is not desirable from an economical viewpoint. Thus, according to this invention the value of the equation: $Mo(\%)+\frac{1}{2}W(\%)$ is defined as from 7.5% to 12%.

Nitrogen (N):

When N is intentionally added to the alloy, N is effective to improve the strength of the resulting alloy. When the N content is less than 0.05%, it is impossible to impart a desired level of strength to the alloy. On the other hand, it is rather difficult to solve N in an amount of more than 0.30% in alloy. Thus, according to this invention, the N content, when it is added, is defined as within 0.05–0.30%, preferably 0.10–0.25% .

Copper (Cu) and Cobalt (Co):

Cu and Co are effective to improve corrosion resistance of the alloy of this invention. Therefore, Cu and/or Co may be added when especially high corrosion resistance is required. However, the addition of Cu and/or Co in an amount of more than 2.0% respectively tends to lower the hot workability. Especially, the effect of Co, which is an expensive alloying element, will be saturated with respect to the resistance to corrosion when it is added in an amount of more than 2.0%. The upper limit each of them is 2.0%.

Rare Earths, Y, Mg and Ca:

They are all effective to improve hot workability. Therefore, when the alloy has to be subjected to severe hot working, it is desirable to incorporate at least one of these elements in the alloy. However, rare earths in an amount of more than 0.10%, or Y more than 0.20%, or Mg more than 0.10%, or Ca more than 0.10% is added, there is no substantial improvement in hot workability. Rather, deterioration in hot workability is sometimes found.

Thus, the addition of these elements is limited to not more than 0.10% for rare earths, 0.20% for Y, 0.10% for Mg and 0.10% for Ca.

Nb, Ti, Ta, Zr and V:

They are equivalent to each other in providing precipitation hardening due to the formation of an intermetallic compound mainly with Ni. When at least one of them is added in the total amount of less than 0.5%, a desired level of strength cannot be obtained. On the other hand, when the total amount of addition is more than 4.0%, the ductility and toughness of the resulting alloy deteriorate and hot workability is also impaired. Therefore, the total amount of addition is defined as within 0.5–4.0%.

Furthermore, since adding them causes the precipitation hardening of the alloy, in the course of the production of tubing and casing for use in oil-wells, it is necessary to apply aging, for example, at a temperature of 450°–800° C. for 1–20 hours before or after the cold working (a reduction in thickness of 10–60%) or at any other appropriate point on the production line.

Of these elements, Nb, V and the combination of these two elements with N are preferable. Thus, in a preferred embodiment of this invention, Nb and/or V are incorporated together with 0.05–0.25% N, preferably 0.10–0.25% N in the alloy.

Furthermore, according to this invention, the Cr, Mo and W content should satisfy the following equation:

$$Cr(\%)+10Mo(\%)+5W(\%)\geqq 110\%$$

FIGS. 3–7 show the relationship between Cr(%)+10Mo(%)+5W(%)and Ni(%) with respect to the resistance to stress corrosion cracking under severe corrosive conditions.

In order to obtain the data shown in FIGS. 3–7, a series of Cr-Ni-Mo alloys, Cr-Ni-W alloys and Cr-Ni-Mo-W alloys, in each of which the proportions of Cr, Ni, Mo and W are varied, were prepared, cast, forged and hot rolled to provide alloy plates 7 mm thick. The resulting plates were then subjected to solid solution treatment in which the plate was kept at 1050° C. for 30 minutes and was water-cooled. After finishing the solid solution treatment cold working was applied with reduction in thichness of 30% in order to improve its strength. Specimens (thickness 2 mm×width 10 mm×length 75 mm) were cut from the cold rolled sheet in the direction perpendicular to the rolling direction.

Figure 6:
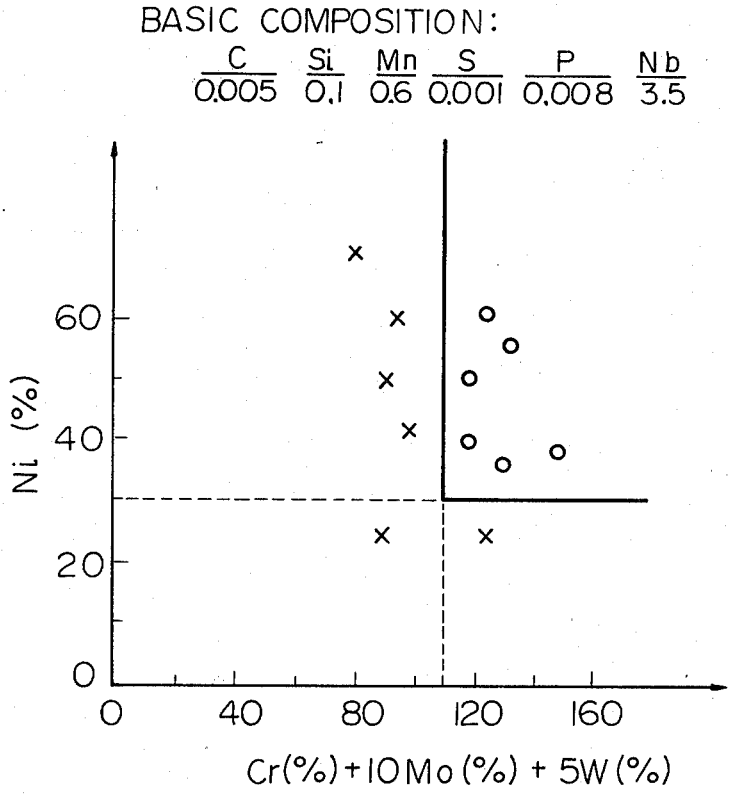
Figure 7:
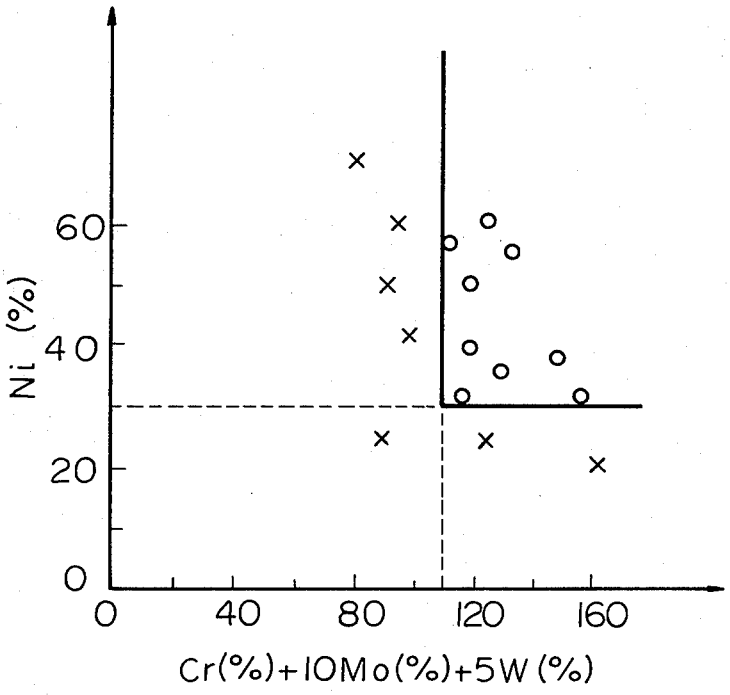
Figure 8:
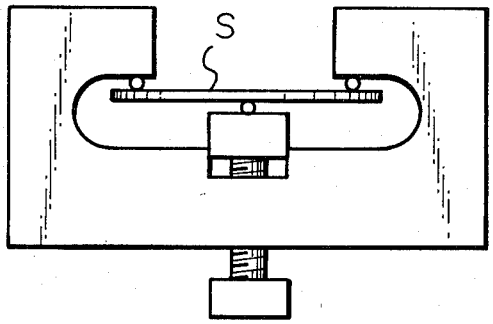
FIG. 8 is a schematic view of a specimen held by a threepoint supporting beam-type jig.

Each of these specimens was held on a three-point supporting beam-type jig as shown in FIG. 8. Thus, the specimen S under tension at a level of a tensile stress corresponding to 0.2% offset yield strength was subjected to the stress corrosion cracking test. Namely, the specimen together with said jig were soaked in a 20% NaCl solution (bath temperature 300° C.) saturated with $H_2S$ and $CO_2$ at a pressure of 10 atms, respectively, for 1000 hours. After soaking for 1000 hours, the occurrence of cracking was visually examined. The resulting data indicates that there is a definite relationship, as shown in FIGS. 3–7, between Ni(%) and the equation: Cr(%)+10Mo(%)+5W(%), which is a parameter first conceived by the inventors of this invention, with respect to the resistance to stress corrosion cracking.

In FIGS. 3–7, the symbol "O" shows the case in which there was no substantial cracking and "X" indicates the occurrence of cracking. As is apparent from the data shown in FIGS. 3–7, when said equation is less than 110% or the Ni content is less than 30%, the intended purpose of this invention cannot be achieved.

Figure 3:
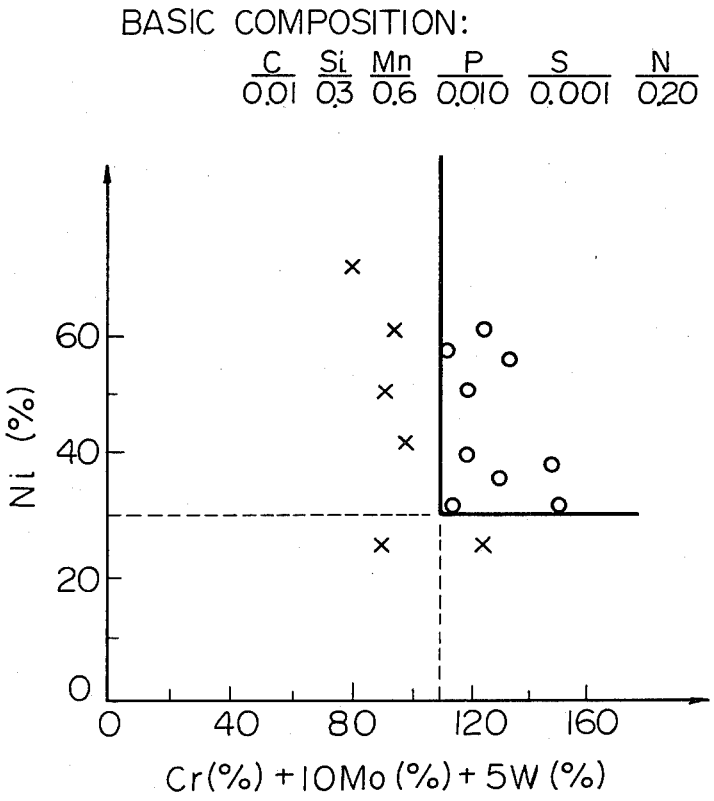
FIG. 3 through FIG. 7 show the relationship between the Ni content and the value of the equation: Cr(%)+10Mo(%)+5W(%) with respect to the resistance to stress corrosion cracking.
Figure 4:
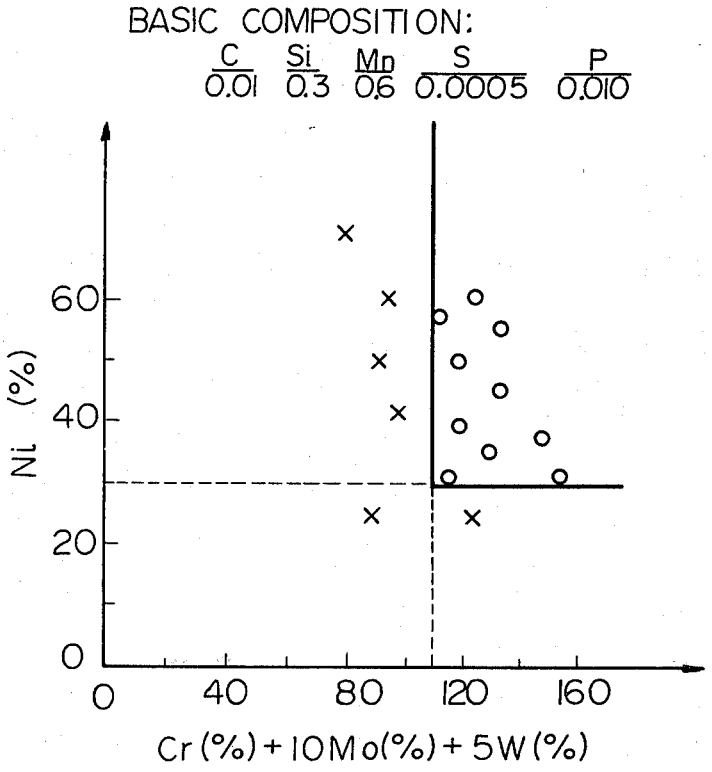
Figure 5:
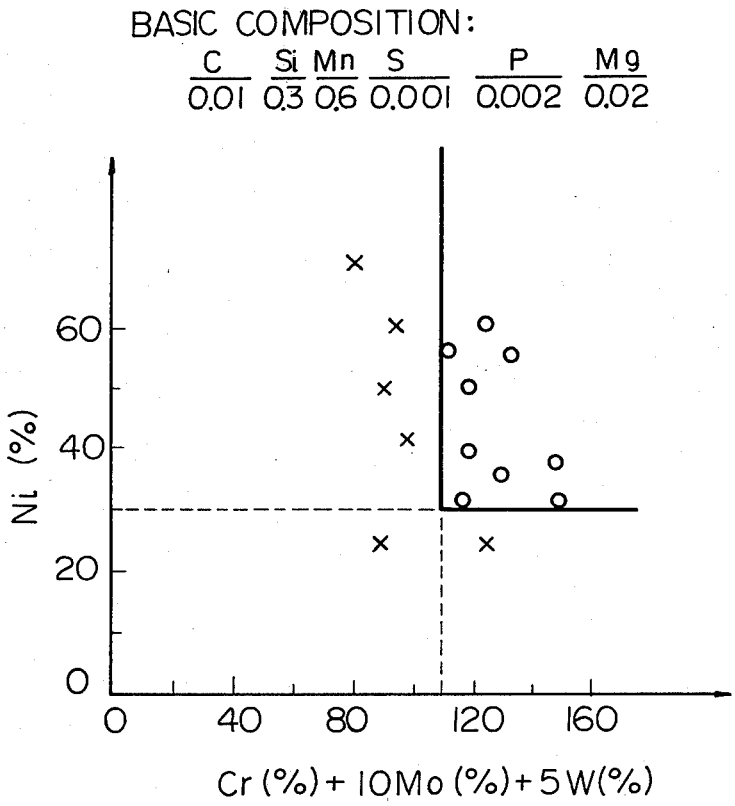

FIG. 3 shows the case in which the alloy contains nitrogen in an amount of 0.05–0.30%. FIG. 4 shows the case in which the S content is restricted to not more than 0.0007%. FIG. 5 shows the case in which the P content is restricted to not more than 0.003%. FIG. 6 shows the case in which Nb in an amount of 0.5–4.0% is added. In this case aging at a temperature of 650° C. for 15 hours was applied after cold working. FIG. 7 shows the case in which the alloy contains not only nitrogen but also the combination of Nb and V. In this case, too, the aging was applied.

The alloy of this invention may include as incidental impurities B, Sn, Pb, Zn, etc. each in an amount of less than 0.1% without rendering any adverse effect on the properties of the alloy.

EXAMPLES

Molten alloys each having respective alloy compositions shown in Tables 1, 3–6 and 8 were prepared by using a combination of a conventional electric arc furnace, an Ar-Oxygen decarburizing furnace (AOD furnace) when it is necessary to carry out desulfurization and nitrogen addition, and an electro-slag remelting furnace (ESR furnace) when it is necessary to carry out dephosphorization. The thus prepared alloy was then cast into a round ingot having a diameter of 500 mm, to which hot forging was applied at a temperature of 1200° C. to provide a billet 150 mm in diameter.

During the hot forging the billet was visually examined for the formation of cracks for the purpose of evaluating the hot workability of the alloy. The billet was then subjected to hot extrusion to provide a pipe having a dimension of 60 mm diameter×4 mm wall thickness, and the thus obtained pipe was then subjected to cold reducing with a reduction in thickness of 22% to apply cold working to the pipe. The resulting pipe was 55 mm in diameter and had a wall thickness of 3.1 mm.

Thus, pipes of this invention alloy, comparative ones in which some of their alloying elements are outside the range of this invention, and conventional ones were prepared.

Figure 9:
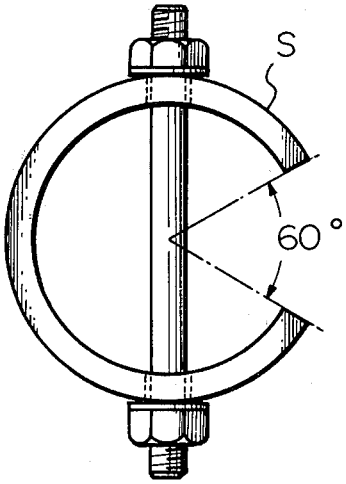
FIG. 9 is a schematic view of a testing sample put under tension by using a bolt-and-nut.

A ring-shaped specimen 20 mm long was cut from each of those pipes and then a portion of the circumferential length of the ring corresponding to the angle of 60° was cut off as shown in FIG. 9. The thus obtained test specimen S was put under tension on the surface thereof at a tensile stress level corresponding to 0.2% off-set yield strength by means of a bolt-and-nut provided through the opposite wall portions of the ring. The specimen together with the bolt-and-nut was soaked in a 20% NaCl solution (bath temp. 300° C.) for 1000 hours. The solution was kept in equilibrium with the atmosphere wherein the $H_2S$ partial pressure was 0.1 atm., or 1 atm. or 15 atms and the partial pressure of $CO_2$ was 10 atms. After finishing the stress corrosion cracking test in said NaCl solution, it was determined whether or not stress corrosion cracking had occurred. The test results are summarized in Tables 2–5, 7 and 9 together with the test results of hot working cracking during the hot forging, hydrogen embrittlement and mechanical properties of the alloy. In Tables 2–5, 7 and 9 in each column, the symbol "O" indicates the case where there was no cracking, and the symbol "X" shows the case where cracking occurred.

As is apparent from the experimental data, the comparative pipes do not meet the standards for any one of hot workability, tensile strength and stress corrosion cracking resistance. On the other hand, the pipes of this invention alloy are satisfactory respect to all these properties. Namely, the pipes made of this invention alloy have a desired level of mechanical strength and resistance to stress corrosion cracking as well as satisfactory hot workability, and with respect to these properties are also superior to those of the conventional pipes made of conventional alloys.

TABLE 1

| | Alloy No. | Alloy Composition (Weight %) | | | | | | | | | | | | | | |
|---|---|---|---|---|---|---|---|---|---|---|---|---|---|---|---|---|
| | | C | Si | Mn | P | S | Al | Ni | Cr | Mo | W | Cu | N | Others | (1) | (2) |
| This Invention | 1 | 0.02 | 0.30 | 0.79 | 0.019 | 0.001 | 0.18 | 51.0 | 19.8 | 10.3 | — | 0.4 | 0.031 | Y 0.021 | 122.8 | 10.3 |
| | 2 | 0.02 | 0.31 | 0.80 | 0.025 | 0.001 | 0.11 | 55.6 | 24.9 | 9.1 | 0.9 | — | 0.015 | Ca 0.016 | 120.4 | 9.6 |
| | 3 | 0.03 | 0.30 | 0.81 | 0.006 | 0.002 | 0.08 | 55.0 | 27.7 | 8.3 | 1.4 | — | 0.008 | Ca 0.008 Mg 0.012 | 117.7 | 9.0 |
| | 4 | 0.01 | 0.24 | 0.75 | 0.014 | 0.001 | 0.09 | 41.5 | 16.0 | 8.8 | 2.4 | 0.7 | 0.042 | — | 126.0 | 10.0 |

TABLE 1-continued

| | Alloy No. | Alloy Composition (Weight %) C | Si | Mn | P | S | Al | Ni | Cr | Mo | W | Cu | N | Others | (1) | (2) |
|---|---|---|---|---|---|---|---|---|---|---|---|---|---|---|---|---|
| | 5 | 0.01 | 0.23 | 0.80 | 0.018 | 0.003 | 0.20 | 35.9 | 15.5 | 10.2 | — | 0.8 | 0.018 | La + Ce 0.021 Ti 0.28 | 117.5 | 10.2 |
| | 6 | 0.007 | 0.22 | 0.78 | 0.009 | 0.004 | 0.14 | 45.0 | 20.4 | 9.1 | 0.5 | — | 0.026 | — | 113.9 | 9.4 |
| | 7 | 0.009 | 0.29 | 0.88 | 0.011 | 0.0006 | 0.15 | 48.8 | 15.8 | 11.2 | — | — | 0.030 | Y: 0.033 | 127.8 | 11.2 |
| | 8 | 0.03 | 0.35 | 0.67 | 0.015 | 0.0009 | 0.12 | 55.3 | 20.6 | 10.5 | 0.6 | — | 0.012 | — | 128.6 | 10.8 |
| | 9 | 0.01 | 0.27 | 0.90 | 0.013 | 0.002 | 0.14 | 50.4 | 25.0 | 9.8 | 1.1 | 0.5 | 0.034 | Mg 0.016 | 128.5 | 10.4 |
| Comparative | 1 | 0.01 | 0.39 | 0.78 | 0.010 | 0.001 | 0.32 | 25.5 | 19.4 | 6.9 | 0.5 | — | 0.020 | — | 90.9 | 7.2 |
| | 2 | 0.02 | 0.25 | 0.78 | 0.017 | 0.002 | 0.13 | 49.9 | 17.4 | 6.2 | 1.2 | 0.3 | 0.028 | La + Ce 0.018 | 85.4 | 6.8 |
| | 3 | 0.02 | 0.23 | 0.68 | 0.015 | 0.001 | 0.13 | 50.3 | 35.8 | 10.3 | — | — | 0.035 | — | 138.8 | 10.3 |
| | 4 | 0.02 | 0.23 | 0.73 | 0.018 | 0.013 | 0.17 | 48.8 | 19.5 | 9.5 | 0.8 | — | 0.007 | — | 118.5 | 9.9 |
| | 5 | 0.01 | 0.31 | 0.72 | 0.015 | 0.004 | 0.25 | 50.3 | 20.8 | 10.6 | — | — | 0.010 | Y 0.32 | 126.8 | 10.6 |
| | 6 | 0.01 | 0.30 | 0.70 | 0.014 | 0.002 | 0.20 | 49.5 | 20.3 | 10.2 | — | — | 0.034 | Mg 0.20 | 122.3 | 10.2 |

NOTE:
(1) Cr (%) + 10Mo (%) + 5W (%)
(2) Mo (%) + ½W (%)

TABLE 2

| | Alloy No. | Cracking during hot forging | Cracking in $H_2S$ - 10 atm $CO_2$ in 20% NaCl: $H_2S$ 0.1 atm | $H_2S$ 1 atm | $H_2S$ 15 atms |
|---|---|---|---|---|---|
| This Invention | 1 | O | O | O | O |
| | 2 | O | O | O | O |
| | 3 | O | O | O | O |
| | 4 | O | O | O | O |
| | 5 | O | O | O | O |
| | 6 | O | O | O | O |
| | 7 | O | O | O | O |
| | 8 | O | O | O | O |
| | 9 | O | O | O | O |

TABLE 2-continued

| | Alloy No. | Cracking during hot forging | Cracking in $H_2S$ - 10 atm $CO_2$ in 20% NaCl: $H_2S$ 0.1 atm | $H_2S$ 1 atm | $H_2S$ 20 atms |
|---|---|---|---|---|---|
| Comparative | 1 | O | O | X | X |
| | 2 | O | O | O | X |
| | 3 | X | — | — | — |
| | 4 | X | — | — | — |
| | 5 | X | — | — | — |
| | 6 | X | — | — | — |

NOTE:
Alloy Nos. correspond to those in Table 1.

TABLE 3

| | Alloy No. | Alloy Composition (weight %) C | Si | Mn | P | S | N | Ni | Cr | Mo | W | Others | Cracking during hot forging | 0.2% offset yield strength (kgf/mm²) | Cracking in $H_2S$ 10 atm $CO_2$ in 20% NaCl: $H_2S$ 0.1 atm | $H_2S$ 1 atm | $H_2S$ 15 atms |
|---|---|---|---|---|---|---|---|---|---|---|---|---|---|---|---|---|---|
| This Invention | 1 | 0.01 | 0.22 | 0.61 | 0.010 | 0.001 | 0.059 | 50.8 | 20.1 | 9.6 | — | — | O | 91.5 | O | O | O |
| | 2 | 0.02 | 0.18 | 0.85 | 0.015 | 0.001 | 0.163 | 51.5 | 21.0 | — | 19.5 | — | | 103.0 | | | |
| | 3 | 0.01 | 0.25 | 0.92 | 0.020 | 0.0005 | 0.287 | 51.8 | 25.6 | 9.0 | — | — | | 132.7 | | | |
| | 4 | 0.06 | 0.23 | 1.40 | 0.001 | 0.002 | 0.126 | 33.9 | 17.5 | 9.6 | — | — | | 96.4 | | | |
| | 5 | 0.02 | 0.20 | 0.58 | 0.001 | 0.002 | 0.090 | 59.7 | 19.7 | 9.0 | 1.8 | — | | 95.8 | | | |
| | 6 | 0.03 | 0.15 | 0.70 | 0.013 | 0.001 | 0.110 | 55.5 | 16.2 | 4.1 | 12.5 | — | | 96.1 | | | |
| | 7 | 0.009 | 0.32 | 1.10 | 0.019 | 0.0002 | 0.185 | 55.8 | 33.9 | 7.9 | — | — | | 115.4 | | | |
| | 8 | 0.01 | 0.29 | 0.52 | 0.014 | 0.0005 | 0.142 | 52.5 | 30.5 | 8.6 | — | — | | 101.8 | | | |
| | 9 | 0.02 | 0.22 | 0.45 | 0.002 | 0.0007 | 0.135 | 50.3 | 27.9 | — | 16.9 | — | | 99.4 | | | |
| | 10 | 0.005 | 0.28 | 0.70 | 0.018 | 0.003 | 0.102 | 40.8 | 17.0 | 11.6 | — | — | | 90.9 | | | |
| | 11 | 0.01 | 0.24 | 0.78 | 0.014 | 0.0005 | 0.089 | 50.5 | 16.1 | — | 23.2 | — | | 94.6 | | | |
| | 12 | 0.01 | 0.30 | 0.66 | 0.001 | 0.001 | 0.143 | 54.8 | 19.3 | 6.5 | 10.4 | Cu: 1.4 | | 100.5 | | | |
| | 13 | 0.03 | 0.19 | 0.68 | 0.017 | 0.0003 | 0.212 | 47.1 | 24.2 | 8.9 | — | Co: 1.6 | | 124.2 | | | |
| | 14 | 0.02 | 0.34 | 0.72 | 0.015 | 0.0001 | 0.150 | 49.9 | 20.8 | 6.5 | 6.1 | La + Ce: 0.033 | | 100.1 | | | |
| | 15 | 0.04 | 0.40 | 0.82 | 0.002 | 0.0002 | 0.122 | 38.8 | 18.0 | 9.4 | — | Y: 0.039 | | 97.0 | | | |
| | 16 | 0.01 | 0.44 | 0.75 | 0.010 | 0.001 | 0.105 | 49.6 | 19.5 | 9.2 | — | Mg: 0.027 | | 94.8 | | | |
| | 17 | 0.01 | 0.20 | 0.91 | 0.003 | 0.004 | 0.113 | 43.9 | 20.3 | 7.5 | 4.2 | Ca: 0.045 | | 95.8 | | | |
| | 18 | 0.03 | 0.23 | 0.63 | 0.014 | 0.001 | 0.085 | 57.5 | 17.3 | 10.8 | — | Y: 0.030 Mg: 0.011 | | 94.0 | | | |
| | 19 | 0.02 | 0.28 | 0.75 | 0.018 | 0.0007 | 0.126 | 52.5 | 21.1 | 8.0 | 2.6 | La + Ce: 0.028 Ca: 0.019 | | 96.1 | | | |
| | 20 | 0.007 | 0.33 | 0.44 | 0.015 | 0.001 | 0.127 | 58.0 | 19.2 | 11.2 | — | Y: 0.011, Mg: 0.018 Ca: 0.020 | | 100.5 | | | |
| | 21 | 0.01 | 0.25 | 0.72 | 0.013 | 0.0001 | 0.155 | 54.2 | 24.0 | 8.9 | 1.2 | Cu: 0.8, Y: 0.025 | | 101.0 | | | |
| | 22 | 0.01 | 0.20 | 0.81 | 0.001 | 0.0002 | 0.108 | 51.8 | 18.8 | — | 21.5 | Co: 1.1, Mg: 0.032 | | 98.8 | | | |
| Comparative | 1 | 0.04 | 0.30 | 0.95 | 0.015 | 0.0003 | 0.095 | 28.6* | 16.0 | 9.8 | — | — | O | 90.1 | O | O | X |
| | 2 | 0.01 | 0.22 | 0.65 | 0.010 | 0.0005 | 0.116 | 50.4 | 37.3* | 8.2 | — | — | X | — | — | — | — |
| | 3 | 0.02 | 0.29 | 0.73 | 0.019 | 0.001 | 0.102 | 50.6 | 19.5 | 7.0* | — | — | O | 95.0 | O | O | X |

TABLE 3-continued

| Alloy No. | Alloy Composition (weight %) C | Si | Mn | P | S | N | Ni | Cr | Mo | W | Others | Cracking during hot forging | 0.2% offset yield strength (kgf/mm²) | Cracking in $H_2S$ 10 atm $CO_2$ in 20% NaCl $H_2S$ 0.1 atm | $H_2S$ 1 atm | $H_2S$ 15 atms |
|---|---|---|---|---|---|---|---|---|---|---|---|---|---|---|---|---|
| 4 | 0.01 | 0.31 | 0.65 | 0.014 | 0.0006 | 0.123 | 49.5 | 20.3 | — | 14.3* | — | | 96.6 | | | |

NOTE:
*outside the range of this invention

TABLE 4

| | Alloy No. | Alloy Composition (Weight %) C | Si | Mn | P | S | sol. Al | Ni | Cr | Mo | W | N | Others | Cracking during hot forging | Cracking in $H_2S$ - 10 atm $CO_2$ in 20% NaCl $H_2S$ 0.1 atm | $H_2S$ 1 atm | $H_2S$ 15 atms |
|---|---|---|---|---|---|---|---|---|---|---|---|---|---|---|---|---|---|
| This Invention | 1 | 0.06 | 0.29 | 1.26 | 0.015 | 0.0004 | 0.15 | 31.2 | 16.5 | 9.7 | — | 0.015 | — | O | O | O | O |
| | 2 | 0.04 | 0.25 | 0.84 | 0.021 | 0.0005 | 0.07 | 46.1 | 19.4 | — | 19.6 | 0.019 | — | | | | |
| | 3 | 0.02 | 0.34 | 0.49 | 0.012 | 0.0002 | 0.02 | 59.4 | 20.1 | 9.0 | 1.8 | 0.024 | — | | | | |
| | 4 | 0.08 | 0.19 | 0.76 | 0.013 | 0.0003 | <0.01 | 55.8 | 17.7 | 11.2 | — | 0.007 | — | | | | |
| | 5 | 0.04 | 0.24 | 0.85 | 0.010 | 0.0001 | 0.25 | 50.1 | 34.3 | 8.5 | — | 0.023 | — | | | | |
| | 6 | 0.01 | 0.33 | 0.90 | 0.005 | 0.0002 | 0.19 | 48.4 | 22.5 | 10.6 | — | 0.034 | — | | | | |
| | 7 | 0.006 | 0.42 | 0.86 | 0.008 | 0.0002 | 0.04 | 52.0 | 24.7 | — | 19.3 | 0.019 | — | | | | |
| | 8 | 0.02 | 0.41 | 0.74 | 0.025 | 0.0006 | 0.36 | 54.8 | 19.2 | 4.6 | 9.8 | 0.006 | — | | | | |
| | 9 | 0.05 | 0.28 | 0.66 | 0.019 | 0.0004 | 0.14 | 51.7 | 27.6 | 9.1 | — | 0.012 | Cu: 1.6 | | | | |
| | 10 | 0.01 | 0.20 | 0.53 | 0.014 | 0.0003 | 0.06 | 36.0 | 17.1 | 9.5 | — | 0.027 | Co: 1.7 | | | | |
| | 11 | 0.008 | 0.36 | 0.42 | 0.022 | 0.0001 | 0.11 | 40.9 | 17.5 | 9.7 | — | 0.015 | Y: 0.038 Ce + La: 0.012 | | | | |
| | 12 | 0.02 | 0.25 | 0.72 | 0.013 | 0.0002 | 0.18 | 44.6 | 16.0 | 10.1 | — | 0.010 | Mg: 0.025 Ti: 0.32 | | | | |
| | 13 | 0.03 | 0.26 | 0.82 | 0.011 | 0.0002 | 0.05 | 51.0 | 25.0 | 8.9 | — | 0.017 | Ca: 0.029 | | | | |
| | 14 | 0.01 | 0.41 | 0.42 | 0.009 | 0.0001 | <0.01 | 58.5 | 29.4 | 8.4 | — | 0.012 | Y: 0.018 Mg: 0.014 Ca: 0.015 | | | | |
| | 15 | 0.05 | 0.47 | 0.75 | 0.015 | 0.0003 | 0.13 | 55.0 | 17.2 | 4.4 | 10.8 | 0.016 | Cu: 0.6 Ca: 0.020 | | | | |
| Comparative | 1 | 0.01 | 0.27 | 0.56 | 0.016 | 0.0005 | 0.20 | 27.9* | 15.5 | 9.7 | — | 0.025 | — | O | O | O | X |
| | 2 | 0.05 | 0.23 | 1.03 | 0.015 | 0.0004 | 0.15 | 50.8 | 36.9* | 7.9 | — | 0.024 | — | X | — | — | — |
| | 3 | 0.02 | 0.33 | 0.92 | 0.018 | 0.0004 | 0.09 | 40.2 | 22.1 | 6.8* | — | 0.012 | — | O | O | O | X |
| | 4 | 0.02 | 0.49 | 0.86 | 0.020 | 0.0003 | 0.05 | 41.0 | 21.9 | — | 13.2* | 0.015 | — | | | | |

NOTE:
*outside the range of this invention

TABLE 5

| | Alloy No. | Alloy composition (Weight %) C | Si | Mn | P | S | sol. Al | Ni | Cr | Mo | W | N | Others | Cracking during hot forging | Cracking in $H_2S$ - 10 atm $CO_2$ in 20% NaCl $H_2S$ 0.1 atm | $H_2S$ 1 atm | $H_2S$ 15 atms | $H_2$ Embrittlement |
|---|---|---|---|---|---|---|---|---|---|---|---|---|---|---|---|---|---|---|
| This Invention | 1 | 0.07 | 0.25 | 1.30 | 0.001 | 0.002 | 0.11 | 31.4 | 16.6 | 9.8 | — | 0.014 | — | O | O | O | O | O |
| | 2 | 0.01 | 0.18 | 0.75 | 0.001 | 0.001 | 0.04 | 46.5 | 18.6 | — | 19.6 | 0.008 | — | | | | | |
| | 3 | 0.006 | 0.26 | 0.42 | <0.001 | 0.001 | <0.01 | 59.0 | 17.5 | 9.2 | 2.0 | 0.016 | — | | | | | |
| | 4 | 0.05 | 0.31 | 0.82 | 0.003 | 0.004 | 0.21 | 54.0 | 17.5 | 10.9 | — | 0.027 | — | | | | | |
| | 5 | 0.02 | 0.29 | 0.81 | 0.002 | 0.0002 | 0.14 | 50.3 | 34.0 | 8.3 | — | 0.035 | — | | | | | |
| | 6 | 0.01 | 0.36 | 0.74 | 0.002 | 0.0007 | 0.22 | 49.0 | 22.6 | 10.3 | — | 0.024 | — | | | | | |
| | 7 | 0.008 | 0.39 | 0.65 | <0.001 | 0.0003 | 0.08 | 51.9 | 25.0 | — | 19.5 | 0.012 | — | | | | | |
| | 8 | 0.02 | 0.32 | 0.70 | 0.001 | 0.001 | 0.10 | 55.0 | 19.4 | 4.6 | 9.6 | 0.016 | — | | | | | |
| | 9 | 0.04 | 0.29 | 0.58 | 0.002 | 0.002 | 0.18 | 51.4 | 27.5 | 8.9 | — | 0.007 | Cu: 1.7 | | | | | |
| | 10 | 0.01 | 0.20 | 0.49 | 0.001 | 0.001 | 0.34 | 36.9 | 17.0 | 9.8 | — | 0.010 | Co: 1.5 | | | | | |
| | 11 | 0.01 | 0.35 | 0.40 | 0.003 | 0.0001 | 0.15 | 41.2 | 17.5 | 9.9 | — | 0.015 | Y: 0.031 Ce + La: 0.015 | | | | | |
| | 12 | 0.02 | 0.18 | 0.70 | 0.001 | 0.0005 | <0.01 | 44.9 | 15.9 | 11.0 | — | 0.010 | Mg: 0.019 Ti: 0.28 | | | | | |
| | 13 | 0.03 | 0.29 | 0.79 | <0.001 | 0.0009 | 0.03 | 50.8 | 25.1 | 9.0 | — | 0.012 | Ca: 0.040 | | | | | |

TABLE 5-continued

| | Alloy No. | C | Si | Mn | P | S | sol. Al | Ni | Cr | Mo | W | N | Others | Cracking during hot forging | Cracking in $H_2S$ - 10 atm $CO_2$ in 20% NaCl: $H_2S$ 0.1 atm | $H_2S$ 1 atm | $H_2S$ 15 atms | $H_2$ Embrittlement |
|---|---|---|---|---|---|---|---|---|---|---|---|---|---|---|---|---|---|---|
| | | Alloy composition (Weight %) | | | | | | | | | | | | | | | | |
| | 14 | 0.01 | 0.43 | 0.72 | 0.002 | 0.0002 | 0.15 | 58.2 | 28.9 | 8.6 | — | 0.019 | Y: 0.018 Ca: 0.015 Mg: 0.020 | | | | | |
| | 15 | 0.04 | 0.27 | 0.64 | 0.001 | 0.002 | 0.11 | 54.8 | 17.9 | 4.5 | 10.1 | 0.020 | Cu: 0.6, Ca: 0.025 | | | | | |
| Comparative | 1 | 0.01 | 0.25 | 0.51 | 0.002 | 0.001 | 0.21 | 27.9* | 15.7 | 9.8 | — | 0.026 | — | O | O | O | X | O |
| | 2 | 0.02 | 0.21 | 0.96 | 0.002 | 0.0002 | 0.14 | 51.0 | 36.5* | 7.7 | — | 0.031 | — | X | — | — | — | — |
| | 3 | 0.02 | 0.32 | 0.68 | 0.012 | 0.001 | 0.09 | 48.5 | 21.6 | 6.8* | — | 0.014 | — | O | O | O | X | X |
| | 4 | 0.03 | 0.45 | 0.80 | 0.002 | 0.001 | 0.12 | 43.6 | 21.9 | — | 13.2* | 0.020 | — | | | | | O |

NOTE:
*outside the range of this invention

TABLE 6

| | Alloy No. | C | Si | Mn | P | S | sol. Al | Ni | Cr | Mo | W | Nb | Ti | Ta | Zr | V | N | Others |
|---|---|---|---|---|---|---|---|---|---|---|---|---|---|---|---|---|---|---|
| | | This Invention (Weight %) | | | | | | | | | | | | | | | | |
| This Invention | 1 | 0.02 | 0.32 | 0.25 | 0.024 | 0.002 | 0.12 | 31.8 | 25.1 | 11.5 | — | 3.01 | — | — | — | — | 0.015 | — |
| | 2 | 0.03 | 0.16 | 0.48 | 0.001 | 0.001 | 0.05 | 40.6 | 20.3 | — | 23.1 | — | 0.33 | — | — | 0.24 | 0.013 | — |
| | 3 | 0.01 | 0.09 | 0.52 | 0.016 | 0.001 | 0.18 | 59.0 | 30.2 | 7.8 | 1.1 | — | — | 3.51 | — | — | 0.016 | — |
| | 4 | 0.02 | 0.18 | 0.77 | 0.012 | 0.0005 | 0.24 | 50.3 | 16.1 | 9.5 | — | — | 0.68 | — | 0.11 | — | 0.007 | — |
| | 5 | 0.01 | 0.06 | 0.82 | 0.008 | 0.004 | 0.23 | 45.2 | 34.1 | 7.6 | — | 0.79 | — | — | — | 0.31 | 0.014 | — |
| | 6 | 0.007 | 0.46 | 0.96 | 0.008 | 0.003 | 0.17 | 45.7 | 20.7 | 9.7 | 0.8 | 0.30 | 0.21 | — | — | 0.31 | 0.025 | — |
| | 7 | 0.03 | 0.25 | 0.76 | 0.013 | 0.0008 | 0.21 | 54.6 | 20.6 | 10.6 | 0.6 | — | 0.50 | — | — | 0.20 | 0.016 | — |
| | 8 | 0.06 | 0.25 | 0.79 | 0.016 | 0.0001 | 0.19 | 50.9 | 28.9 | 8.3 | — | 0.40 | 0.21 | — | 0.10 | 0.31 | 0.009 | — |
| | 9 | 0.01 | 0.27 | 0.84 | 0.012 | 0.001 | 0.22 | 41.2 | 16.2 | 8.5 | 2.4 | 0.61 | — | 0.20 | — | — | 0.018 | Cu: 0.60 |
| | 10 | 0.02 | 0.23 | 0.62 | 0.010 | 0.002 | 0.09 | 36.9 | 15.5 | 8.2 | — | — | 0.30 | 2.71 | — | — | 0.006 | La + Ce: 0.024 Co: 1.7 |
| | 11 | 0.005 | 0.42 | 0.58 | 0.012 | 0.0009 | 0.09 | 49.3 | 16.3 | 11.8 | — | — | 0.31 | — | 0.10 | 0.20 | 0.024 | Y: 0.032 |
| | 12 | 0.02 | 0.26 | 0.75 | 0.009 | 0.004 | 0.23 | 55.3 | 27.8 | 8.2 | 1.6 | 0.41 | 0.20 | — | — | — | 0.020 | Mg: 0.023 |
| | 13 | 0.02 | 0.39 | 0.97 | 0.021 | 0.002 | 0.09 | 55.6 | 24.6 | 9.3 | 0.2 | 3.31 | 0.10 | — | — | — | 0.032 | Ca: 0.016 |
| | 14 | 0.01 | 0.18 | 0.93 | 0.014 | 0.002 | 0.22 | 50.2 | 25.8 | 9.3 | 1.4 | 0.50 | 0.21 | — | — | — | 0.014 | Cu: 0.5 Mg: 0.017 |
| | 15 | 0.03 | 0.10 | 1.61 | 0.018 | 0.004 | 0.09 | 38.6 | 30.9 | 8.6 | — | — | — | 0.63 | — | — | 0.010 | La + Ce: 0.028 Mg: 0.005 Ca: 0.018 |
| | 16 | 0.03 | 0.21 | 0.83 | 0.015 | 0.001 | 0.22 | 45.2 | 26.7 | 6.8 | 3.2 | — | 0.46 | — | 0.20 | — | 0.013 | Cu: 1.4 Y: 0.023 Mg: 0.017 Co: 1.1 |
| | | Alloy Composition (Weight %) | | | | | | | | | | | | | | | | |
| Comparative | 1 | 0.01 | 0.38 | 0.88 | 0.016 | 0.002 | 0.09 | 28.2* | 25.8 | 7.9 | 1.2 | 1.10 | — | — | — | — | 0.020 | — |
| | 2 | 0.04 | 0.42 | 0.76 | 0.008 | 0.008 | 0.22 | 35.6 | 37.0* | 5.7 | 3.4 | — | 0.63 | — | 0.16 | — | 0.014 | — |
| | 3 | 0.02 | 0.53 | 0.71 | 0.013 | 0.001 | 0.18 | 45.2 | 20.6 | 7.4* | — | — | 0.31 | 0.25 | — | 0.21 | 0.018 | — |
| | 4 | 0.03 | 0.25 | 0.89 | 0.012 | 0.004 | 0.16 | 50.6 | 16.8 | — | 14.8* | — | — | — | 0.12 | 0.86 | 0.015 | — |
| | 5 | 0.02 | 0.33 | 0.94 | 0.025 | 0.002 | 0.12 | 43.4 | 13.4 | 10.2 | — | — | — | — | — | — | 0.034 | — |
| Conventional | 1 | 0.06 | 0.52 | 1.41 | 0.027 | 0.011 | — | 12.8 | 17.2 | 2.4 | — | — | — | — | — | — | 0.026 | Cu: 0.1 |
| | 2 | 0.06 | 0.50 | 1.29 | 0.028 | 0.012 | — | 20.4 | 25.2 | — | — | — | — | — | — | — | 0.034 | — |
| | 3 | 0.05 | 0.52 | 1.10 | 0.016 | 0.008 | 0.32 | 31.8 | 20.5 | — | — | — | 0.20 | — | — | — | 0.015 | — |
| | 4 | 0.04 | 0.49 | 0.82 | 0.025 | 0.010 | — | 5.4 | 25.4 | 2.2 | — | — | — | — | — | — | 0.032 | — |

NOTE:
*outside the range of this invention

TABLE 7

| | Alloy No. | Cracking during hot forging | Cracking in $H_2S$ - 10 atm $CO_2$ in 20% NaCl: $H_2S$ 0.1 atm | $H_2S$ 1 atm | $H_2S$ 15 atms | 0.2% offset yield strength ($kgf/mm^2$) | Tensile strength ($kgf/mm^2$) | Elongation (%) | Reduction of area (%) | Impact value ($kg \cdot m/cm^2$) at 0° C. |
|---|---|---|---|---|---|---|---|---|---|---|
| This Invention | 1 | O | O | O | O | 121.8 | 128.6 | 12 | 43 | 7.6 |
| | 2 | | | | | 90.4 | 94.8 | 15 | 63 | 7.5 |
| | 3 | | | | | 115.5 | 120.9 | 14 | 49 | 6.3 |
| | 4 | | | | | 89.8 | 93.7 | 18 | 79 | 26.6 |

TABLE 7-continued

| | Alloy No. | Cracking during hot forging | Cracking in $H_2S$ - 10 atm $CO_2$ in 20% NaCl: $H_2S$ 0.1 atm | $H_2S$ 1 atm | $H_2S$ 15 atms | 0.2% offset yield strength (kgf/mm$^2$) | Tensile strength (kgf/mm$^2$) | Elongation (%) | Reduction of area (%) | Impact value (kg · m/cm$^2$) at 0° C. |
|---|---|---|---|---|---|---|---|---|---|---|
| | 5 | | | | | 90.4 | 96.4 | 17 | 72 | 19.1 |
| | 6 | | | | | 94.6 | 101.2 | 13 | 58 | 6.9 |
| | 7 | | | | | 92.6 | 98.7 | 14 | 64 | 17.2 |
| | 8 | | | | | 92.4 | 98.3 | 17 | 72 | 14.2 |
| | 9 | | | | | 90.6 | 96.1 | 15 | 58 | 7.8 |
| | 10 | | | | | 106.3 | 117.8 | 14 | 39 | 7.3 |
| | 11 | | | | | 93.4 | 99.1 | 15 | 68 | 10.3 |
| | 12 | | | | | 93.7 | 98.6 | 14 | 75 | 7.4 |
| | 13 | | | | | 104.2 | 120.6 | 27 | 34 | 6.2 |
| | 14 | | | | | 94.7 | 98.4 | 15 | 67 | 11.6 |
| | 15 | | | | | 95.4 | 100.3 | 12 | 52 | 7.7 |
| | 16 | | | | | 89.6 | 97.3 | 17 | 68 | 11.7 |
| Comparative | 1 | O | O | O | X | 89.4 | 92.3 | 14 | 71 | 6.3 |
| | 2 | X | — | — | — | — | — | — | — | — |
| | 3 | O | O | O | X | 86.8 | 91.3 | 13 | 74 | 11.2 |
| | 4 | | | | | 80.0 | 84.3 | 15 | 74 | 15.1 |
| | 5 | | | | | 86.8 | 90.7 | 18 | 79 | 26.6 |
| Conventional | 1 | O | X | X | X | 71.9 | 72.5 | 19 | 81 | 26.8 |
| | 2 | | | | | 70.3 | 73.9 | 19 | 82 | 15.6 |
| | 3 | | | | | 73.5 | 76.8 | 17 | 80 | 23.6 |
| | 4 | | | | | 90.7 | 93.1 | 16 | 76 | 18.8 |

NOTE:
(1) Alloy Nos. correspond to those in Table 6.
(2) Aging at 650° C. for 15 hours was applied to the invention alloys and comparative alloys after cold working.

TABLE 8

| | Alloy No. | Alloy Composition (Weight %): C | Si | Mn | P | S | N | Ni | Cr | Nb | V | Mo | W | Others |
|---|---|---|---|---|---|---|---|---|---|---|---|---|---|---|
| This Invention | 1 | 0.01 | 0.25 | 0.82 | 0.012 | 0.001 | 0.056 | 50.6 | 26.5 | 1.03 | — | 9.6 | — | — |
| | 2 | 0.04 | 0.16 | 0.86 | 0.008 | 0.002 | 0.148 | 41.3 | 29.8 | 0.68 | 0.72 | 7.2 | 2.5 | — |
| | 3 | 0.02 | 0.12 | 0.92 | 0.016 | 0.001 | 0.246 | 30.7 | 26.6 | 0.38 | 0.36 | 5.9 | 6.1 | — |
| | 4 | 0.02 | 0.11 | 0.71 | 0.0003 | 0.001 | 0.073 | 59.0 | 20.5 | 2.68 | — | 8.6 | 1.5 | — |
| | 5 | 0.01 | 0.03 | 0.77 | 0.023 | 0.003 | 0.136 | 38.6 | 15.9 | — | 1.96 | 10.9 | — | — |
| | 6 | 0.01 | 0.18 | 0.83 | 0.010 | 0.0002 | 0.099 | 40.2 | 34.1 | 1.00 | 0.72 | 7.2 | 0.9 | — |
| | 7 | 0.03 | 0.22 | 0.79 | 0.016 | 0.004 | 0.158 | 35.1 | 21.3 | 0.64 | — | 6.9 | 9.6 | — |
| | 8 | 0.02 | 0.24 | 0.88 | 0.015 | 0.003 | 0.059 | 55.8 | 25.2 | 3.81 | — | 6.3 | 7.2 | — |
| | 9 | 0.04 | 0.26 | 0.92 | 0.012 | 0.002 | 0.183 | 40.2 | 27.6 | — | 0.56 | 9.7 | — | — |
| | 10 | 0.02 | 0.23 | 0.86 | 0.0001 | 0.001 | 0.102 | 56.9 | 20.9 | — | 3.90 | 8.6 | 2.4 | — |
| | 11 | 0.04 | 0.14 | 1.76 | 0.009 | 0.0007 | 0.122 | 46.7 | 33.5 | 0.55 | — | 8.3 | — | — |
| | 12 | 0.01 | 0.09 | 0.91 | 0.018 | 0.002 | 0.136 | 45.9 | 18.6 | 0.97 | — | 11.5 | — | — |
| | 13 | 0.02 | 0.13 | 0.72 | 0.021 | 0.002 | 0.101 | 49.7 | 30.1 | 1.53 | — | — | 17.3 | — |
| | 14 | 0.01 | 0.19 | 0.69 | 0.014 | 0.001 | 0.098 | 51.3 | 25.6 | 2.09 | — | — | 23.0 | — |
| | 15 | 0.02 | 0.17 | 0.45 | 0.014 | 0.003 | 0.113 | 47.6 | 23.5 | 1.55 | — | 7.5 | 3.6 | Cu: 1.8 |
| | 16 | 0.03 | 0.38 | 0.75 | 0.015 | 0.003 | 0.130 | 38.6 | 18.5 | 0.80 | — | 9.8 | — | Co: 1.4 |
| | 17 | 0.02 | 0.26 | 0.38 | 0.012 | 0.002 | 0.069 | 48.7 | 16.9 | 2.52 | — | 10.1 | — | Y: 0.046 |
| | 18 | 0.02 | 0.19 | 1.16 | 0.008 | 0.002 | 0.155 | 39.2 | 19.6 | 0.96 | 0.12 | 9.6 | — | Mg: 0.023 |
| | 19 | 0.04 | 0.18 | 0.68 | 0.013 | 0.003 | 0.148 | 45.0 | 20.5 | 0.03 | 1.16 | 9.8 | — | Ca: 0.026 |
| | 20 | 0.01 | 0.20 | 0.52 | 0.016 | 0.001 | 0.071 | 51.5 | 28.4 | 0.70 | — | 8.5 | 0.3 | La + Ce: 0.029, Co: 1.0 |
| | 21 | 0.01 | 0.28 | 0.66 | 0.012 | 0.001 | 0.090 | 42.3 | 21.0 | 1.60 | 0.21 | 9.0 | 0.6 | Cu: 0.4, Mg: 0.010, Ca: 0.019 |
| | 22 | 0.01 | 0.26 | 0.51 | 0.018 | 0.002 | 0.102 | 50.8 | 20.4 | 2.51 | — | 9.5 | — | Cu: 0.3, Co: 1.1, Y: 0.031 |
| Comparative | 1 | 0.01 | 0.35 | 0.78 | 0.021 | 0.001 | 0.041 | 45.9 | 17.2 | 0.92 | — | 6.2 | 2.5 | — |
| | 2 | 0.01 | 0.27 | 0.96 | 0.018 | 0.003 | 0.101 | 28.1* | 20.5 | 1.64 | 0.21 | 9.6 | — | — |
| | 3 | 0.03 | 0.21 | 0.86 | 0.016 | 0.007 | 0.086 | 36.8 | 36.4* | — | 1.03 | 7.3 | 2.6 | — |
| | 4 | 0.02 | 0.38 | 0.74 | 0.013 | 0.004 | 0.103 | 45.9 | 19.2 | 0.40* | — | 5.8 | 4.2 | — |
| | 5 | 0.01 | 0.29 | 0.68 | 0.019 | 0.002 | 0.107 | 36.8 | 25.6 | 4.8* | 0.24 | 5.1 | — | — |
| | 6 | 0.03 | 0.33 | 0.88 | 0.021 | 0.001 | 0.122 | 40.9 | 31.2 | — | 0.41* | 4.3 | 1.9 | — |
| | 7 | 0.04 | 0.31 | 0.73 | 0.022 | 0.005 | 0.076 | 45.6 | 25.6 | 0.83 | — | 7.2* | — | — |
| | 8 | 0.06 | 0.26 | 0.76 | 0.017 | 0.003 | 0.058 | 50.2 | 18.1 | 0.91 | — | — | 14.8* | — |

NOTE:
*outside the range of this invention

TABLE 9

| | Alloy No. | Cracking during hot forging | 0.2% offset yield strength (kgf/mm$^2$) | Impact value (kg · m/cm$^2$ at 0° C.) | Cracking in $H_2S$ - 10 atm $CO_2$ in 20% NaCl: $H_2S$ 0.1 atm | $H_2S$ 1 atm | $H_2S$ 15 atms |
|---|---|---|---|---|---|---|---|
| This Invention | 1 | O | 91.8 | 11.7 | O | O | O |
| | 2 | | 98.4 | 10.6 | | | |
| | 3 | | 109.4 | 4.5 | | | |

TABLE 9-continued

| Alloy No. | Cracking during hot forging | 0.2% offset yield strength (kgf/mm$^2$) | Impact value (kg · m/cm$^2$ at 0° C.) | Cracking in $H_2S$ - 10 atm $CO_2$ in 20% NaCl: $H_2S$ 0.1 atm | $H_2S$ 1 atm | $H_2S$ 15 atms |
|---|---|---|---|---|---|---|
| 4 | | 104.8 | 12.3 | | | |
| 5 | | 90.4 | 11.6 | | | |
| 6 | | 105.4 | 3.6 | | | |

TABLE 9-continued

| | Alloy No. | Cracking during hot forging | 0.2% offset yield strength (kgf/mm²) | Impact value (kg · m/cm² at 0° C.) | Cracking in $H_2S$ - 10 atm $CO_2$ in 20% NaCl $H_2S$ 0.1 atm | $H_2S$ 1 atm | $H_2S$ 15 atms |
|---|---|---|---|---|---|---|---|
| | 7 | | 100.4 | 5.7 | | | |
| | 8 | | 113.5 | 7.5 | | | |
| | 9 | | 99.1 | 12.1 | | | |
| | 10 | | 114.8 | 7.1 | | | |
| | 11 | | 99.6 | 3.2 | | | |
| | 12 | | 97.1 | 12.0 | | | |
| | 13 | | 101.4 | 4.2 | | | |
| | 14 | | 101.8 | 5.8 | | | |
| | 15 | | 98.3 | 10.7 | | | |
| | 16 | | 101.5 | 7.5 | | | |
| | 17 | | 101.8 | 7.3 | | | |
| | 18 | | 98.4 | 5.7 | | | |
| | 19 | | 97.4 | 11.7 | | | |
| | 20 | | 90.8 | 6.8 | | | |
| | 21 | | 104.4 | 8.1 | | | |
| | 22 | | 118.3 | 8.7 | | | |
| Comparative | 1 | O | 84.7 | 13.3 | O | O | X |
| | 2 | | 89.3 | 1.3 | | | |
| | 3 | X | — | — | — | — | — |
| | 4 | O | 85.0 | 11.2 | O | O | X |
| | 5 | | 108.8 | 0.2 | | X | |
| | 6 | | 90.4 | 2.6 | | O | |
| | 7 | | 89.9 | 4.5 | | | |
| | 8 | | 91.0 | 11.2 | | | |

NOTE:
(1) Alloy Nos. correspond to those in Table 8
(2) Aging at 650° C. for 15 hours was applied after cold working.

As has been described thoroughly hereinbefore, the alloy of this invention is superior in its high level of mechanical strength and resistance to stress corrosion cracking and is especially useful for manufacturing casing, tubing, liners and drill pipes for use in deep wells for producing petroleum crude oil, natural gas and geothermal water and other purposes.

What is claimed is:

1. An alloy for use in making high strength deep well casing and tubing having improved resistance to stress-corrosion cracking, the alloy composition consisting essentially of:

| | |
|---|---|
| C: ≦0.1% | Si: ≦1.0% |
| Mn: ≦2.0% | P: ≦0.030% |
| S: ≦0.005% | N: 0–0.30% |
| Ni: 30–60% | Cr: 15–35% |
| Mo: 0–12% | W: 0–24% |
| Cr(%) + 10Mo(%) + 5W(%) ≧ 110%, | |
| 7.5% ≦ Mo(%) + ½W(%) ≦ 12% | |
| Cu: 0–2.0% | Co: 0–2.0% |
| rare earths: 0–0.10% | Y: 0–0.20% |
| Mg: 0–0.10% | Ca: 0–0.10% |
| Fe and incidental impurities: balance. | |

2. An alloy as defined in claim 1, in which the nickel content is from 40 to 60%.

3. An alloy as defined in claim 1, in which the sulfur content is not more than 0.0007%.

4. An alloy as defined in claim 1, 2 or 3, in which the phosphorous content is not more than 0.003%.

5. An alloy for use in making high strength deep well casing and tubing having improved resistance to stress corrosion cracking, the alloy composition consisting essentially of:

| | |
|---|---|
| C: ≦0.1% | Si: ≦1.0% |
| Mn: ≦2.0% | P: ≦0.030% |
| S: ≦0.005% | N: 0–0.30% |
| Ni: 30–60% | Cr: 15–35% |
| Mo: 0–12% | W: 0–24% |
| Cr(%) + 10Mo(%) + 5W(%) ≧ 110% | |
| 7.5% ≦ Mo(%) + ½W(%) ≦ 12% | |
| Cu: 0–2.0% | Co: 0–2.0% |
| rare earths: 0–0.10% | Y: 0–0.20% |
| Mg: 0–0.10% | Ca: 0–0.10% |
| one or more of Nb, Ti, Ta, Zr and V in the total amount of 0.5–4.0% | |
| Fe and incidental impurities: balance. | |

6. An alloy as defined in claim 5, in which the nickel content is from 40–60%.

7. An alloy as defined in claim 5, in which the sulfur content is not more than 0.0007%.

8. An alloy as defined in claim 5, 6 or 7, in which the phosphorous content is not more than 0.003%.

9. An alloy for use in making high strength deep well casing and tubing having improved resistance to stress-corrosion cracking, the alloy composition consisting essentially of:

| | |
|---|---|
| C: ≦0.1% | Si: ≦1.0% |
| Mn: ≦2.0% | P: ≦0.030% |
| S: ≦0.005% | N: 0.05–0.30% |
| Ni: 30–60% | Cr: 15–35% |
| Mo: 0–12% | W: 0–24% |
| Cr(%) + 10Mo(%) + 5W(%) ≧ 110%, | |
| 7.5% ≦ Mo(%) + ½W(%) ≦ 12% | |
| Cu: 0–2.0% | Co: 0–2.0% |
| rare earths: 0–0.10% | Y: 0–0.20% |
| Mg: 0–0.10% | Ca: 0–0.10% |
| Fe and incidental impurities: balance. | |

10. An alloy as defined in claim 9, in which the content of nickel is from 40 to 60%.

11. An alloy as defined in claim 9, in which the sulfur content is not more than 0.0007%.

12. An alloy as defined in claim 9, 10 or 11, in which the phosphorous is not more than 0.003%.

13. An alloy as defined in claim 12, in which the N content is 0.10–0.25%.

14. An alloy for use in making high strength deep cell casing and tubing having improved resistance to stress corrosion cracking, the alloy composition consisting essentially of:

| | |
|---|---|
| C: ≦0.1% | Si: ≦1.0% |
| Mn: ≦2.0% | P: ≦0.030% |
| S: ≦0.005% | N: 0.05–0.30% |
| Ni: 30–60% | Cr: 15–35% |
| Mo: 0–12% | W: 0–24% |
| Cr(%) + 10Mo(%) + 5W(%) ≧ 110% | |
| 7.5% ≦ Mo(%) + ½W(%) ≦ 12% | |
| Cu: 0–2.0% | Co: 0–2.0% |
| rare earths: 0–0.10% | Y: 0–0.20% |
| Mg: 0–0.10% | Ca: 0–0.10% |
| one or more of Nb, Ti, Ta, Zr and V in the total amount of 0.5–4.0% | |
| Fe and incidental impurities: balance. | |

15. An alloy as defined in claim 14, in which the nickel content is from 40 to 60%.

16. An alloy as defined in claim 14, in which the sulfur content is not more than 0.0007%.

17. An alloy as defined in claim 14, 15 or 16, in which the phosphorous content is not more than 0.003%.

18. An alloy as defined in claim 17, in which the N content is 0.10–0.25%.

19. An alloy for use in making high strength deep well casing and tubing having improved resistance to stress corrosion cracking, the alloy composition consisting essentially of:

| | |
|---|---|
| C: ≦0.1% | Si: ≦1.0% |
| Mn: ≦2.0% | P: ≦0.030% |
| S: ≦0.005% | N: 0.05–0.30% |
| Ni: 30–60% | Cr: 15–35% |
| Mo: 0–12% | W: 0–24% |

$Cr(\%) + 10Mo(\%) + 5W(\%) \geqq 110\%$ $7.5\% \leqq Mo(\%) + \frac{1}{2}W(\%) \leqq 12\%$ -continued

| | |
|---|---|
| Cu: 0–2.0% | Co: 0–2.0% |
| rare earths: 0–0.10% | Y: 0–0.20% |
| Mg: 0–0.10% | Ca: 0–0.10% |

one or more of Nb and V in the total amount of 0.5–4.0%

Fe and incidental impurities: balance.

20. An alloy as defined in claim 19, in which the nickel content is from 40–60%.

21. An alloy as defined in claim 19, in which the sulfur content is not more than 0.0007%.

22. An alloy as defined in claim 19, 20 or 21, in which the phosphorous content is not more than 0.003%.

* * * * *